United States Patent [19]

Garrick

[11] 4,121,803

[45] Oct. 24, 1978

[54] FLAGHOLDER

[76] Inventor: John S. Garrick, Mayhew's Trailer Park, West Campton, N.H. 03228

[21] Appl. No.: 778,629

[22] Filed: Mar. 17, 1977

[51] Int. Cl.[2] ..... A47F 5/00

[52] U.S. Cl. ..... 248/536; 248/226.4

[58] Field of Search ..... 248/535, 536, 538, 539, 248/540, 226.1, 226.2, 226.3, 226.4; 24/263 A

[56] References Cited

U.S. PATENT DOCUMENTS

| | | | |
|---|---|---|---|
| 161,088 | 3/1875 | Bacon | 248/226.1 |
| 1,564,703 | 12/1925 | Nichols | 248/226.1 |
| 1,597,266 | 8/1926 | Dearman | 248/536 |
| 2,731,224 | 1/1956 | MacDonald | 248/226.3 |
| 2,830,781 | 4/1958 | Coulter | 248/226.3 |
| 3,131,927 | 5/1964 | Penix | 24/263 A |

*Primary Examiner*—Robert A. Hafer
*Attorney, Agent, or Firm*—Thomas N. Tarrant

[57] ABSTRACT

A flagholder particularly suited for mounting on gravestones in which two similar side members are drawn together in clamping fashion on either side of the mounting structure by a bolt passing through one end into the other. The flagstaff is secured in a hole recessed in one of the side members or in an intermediate member resting on top of the mounting structure.

1 Claim, 4 Drawing Figures

FLAGHOLDER

BACKGROUND OF THE INVENTION

1. Field of the Invention

The present invention relates to flagholders and in particular to such holders fashioned as a clamp for mounting upon a separate structure.

2. Description of the Prior Art

Devices for holding flags have been designed to mount on various parts of a vehicle, for example, the rain gutter of a car. Also, there are flagholders for various locations on a house such as a windowsill. But otherwise out-of-door mountings have generally been from permanently anchored flagpoles or within sleeves permanently anchored in the ground. None of these various arrangements have been entirely satisfactory for some purposes such as the use of flags on the graves of veterans and the like. A common practice has been to place wooden staffs of inexpensive flags directly into the ground adjacent the gravestone. This practice has caused a great deal of difficulty in the proper maintenance of the cemeteries involved.

SUMMARY OF THE INVENTION

In accordance with the present invention, a flagholder is provided particularly suited for mounting on an upright structure of limited thickness such as a gravestone. The flagholder is made of a plurality of members, including portions extending over opposite sides of the mounting structure, i.e., gravestone, and portions resting on top of the mounting structure. These members are interconnected and clamped to the mounting structure by a threaded bolt or the like. A flagstaff is mounted in a hole recessed in one of the members. Thus it is an object of the invention to provide a novel flagholder for clamping to an upright structure.

Further objects and features of the invention will become apparent upon reading the following description together with the drawing.

DESCRIPTION OF THE PREFERRED EMBODIMENTS

Figure 1:
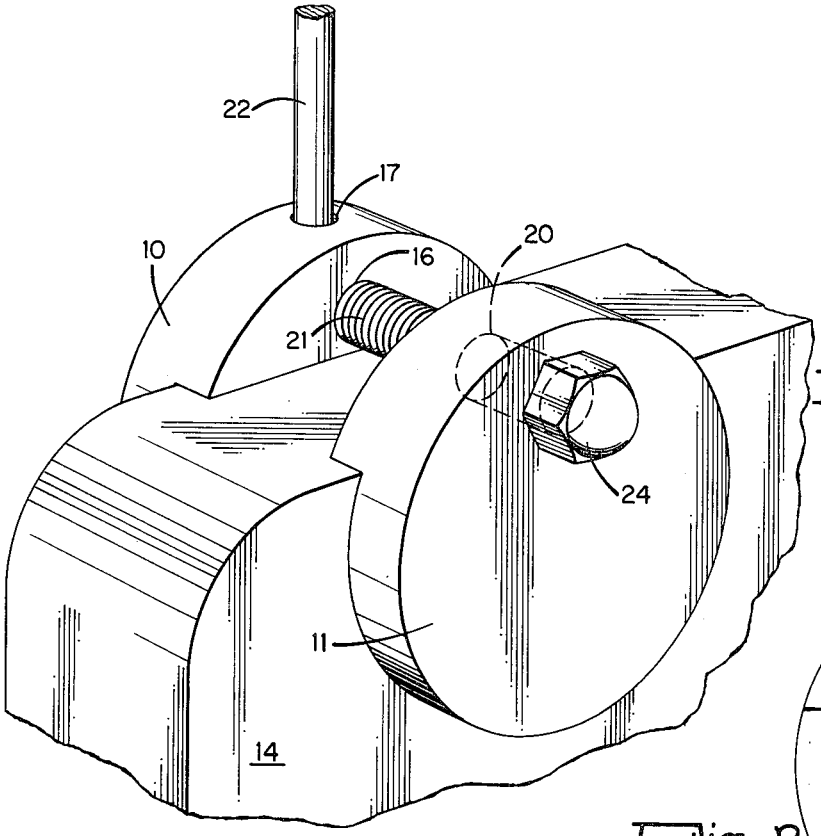
FIG. 1 is a perspective view of a flagholder according to one embodiment of the invention mounted on a portion of a gravestone.
Figure 2:
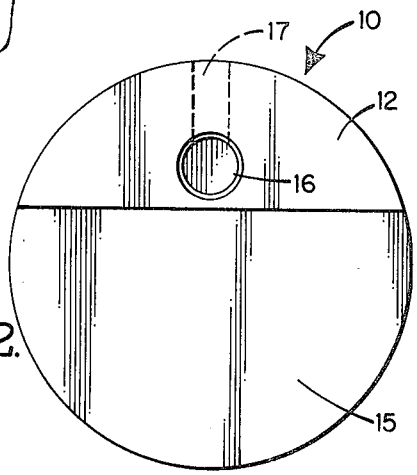
FIG. 2 is a rear elevation of one of the clamping members of FIG. 1.
Figure 4:
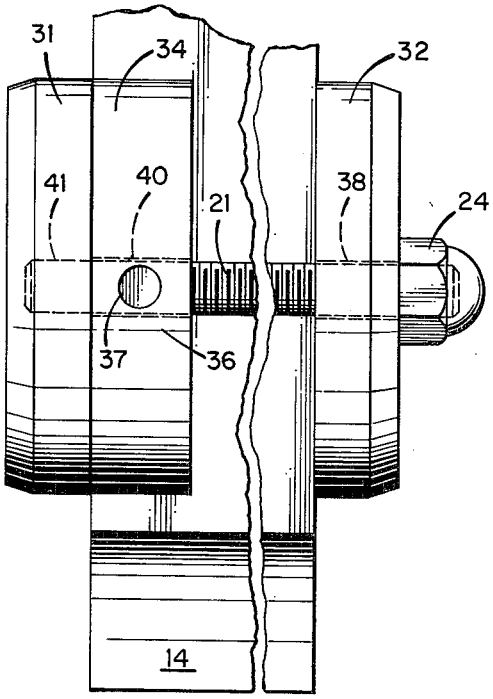
FIG. 4 is a top plan view of the embodiment of FIG. 3.

A flagholder in accordance with the invention is neat in appearance, inexpensive, and made of molded plastic or metal components. Since the number of different components that must be cast or molded has a significant effect on the manufacturing cost, a preferred arrangement as depicted in FIG. 1 uses only one casting. Thus the flagholder of FIG. 1 is comprised essentially of two members 10 and 11 made from identical castings. Members 10 and 11 are suitably diecast from aluminum, magnesium, white metal, or the like. They may also be molded from various plastics. Each piece 10 and 11, as depicted in more detail in FIG. 2, has a top portion 12 that is thicker than the bottom portion so that the top portion may ride over the edge of an upright mounting structure such as gravestone 14 depicted in FIG. 1. Lower portion 15 is designed to depend over the side of the mounting structure for clamping purposes as will be discussed below.

Whereas members 10 and 11 are depicted as circular in shape, this is not intended to be limiting since they may readily be made as a square, rectangle, oblong, oval or other convenient or ornamental shape.

Member 10 has a first aperture 16 drilled centrally in thicker portion 12. Aperture 16 is threaded to receive a bolt.Member 10 has a second aperture 17 in the form of a hole recessed in its top surface and intersecting with aperture 16. Aperture 16 may pass entirely through member 10 but preferably terminates at the intersection with aperture 17 so as to leave the outside surface of member 10 continuous. Aperture 17 is made of a size to accept a flagstaff of the desired type.

Member 11 contains an aperture 20 located centrally and passing entirely through member 11. Aperture 20 is located centrally in the thick portion of member 11 corresponding to aperture 16 in member 10. Members 10 and 11 are secured together by bolt 21 threaded into aperture 16 with a flagstaff 22 mounted in aperture 17.

It will be seen that bolt 21 may be threaded in until it clamps flagstaff 22 tightly in position. Bolt 21 is suitably a threaded rod having a length adequate to connect members 10 and 11 across the thickness of the various probable upright structures with which it will be used. Once the thickness of the upright structure 14 upon which the flagholder is to be mounted is known, bolt 21 is preferably cut to leave a short projection upon which a cap nut 24 is threaded and tightened to secure the flagholder in position.

A satisfactory flagholder made for use on a gravestone has been made of aluminum with members 10 and 11 having a diameter of approximately 8 centimeters. The upper thicker portion was approximately 3 centimeters of the 8 centimeters and had a thickness of approximately 27.5 millimeters, while the lower, thinner portion had a thickness of approximately 7.5 millimeters. The transition between the thicker and thinner portions was made along a straight line and at right angles.

Figure 3:
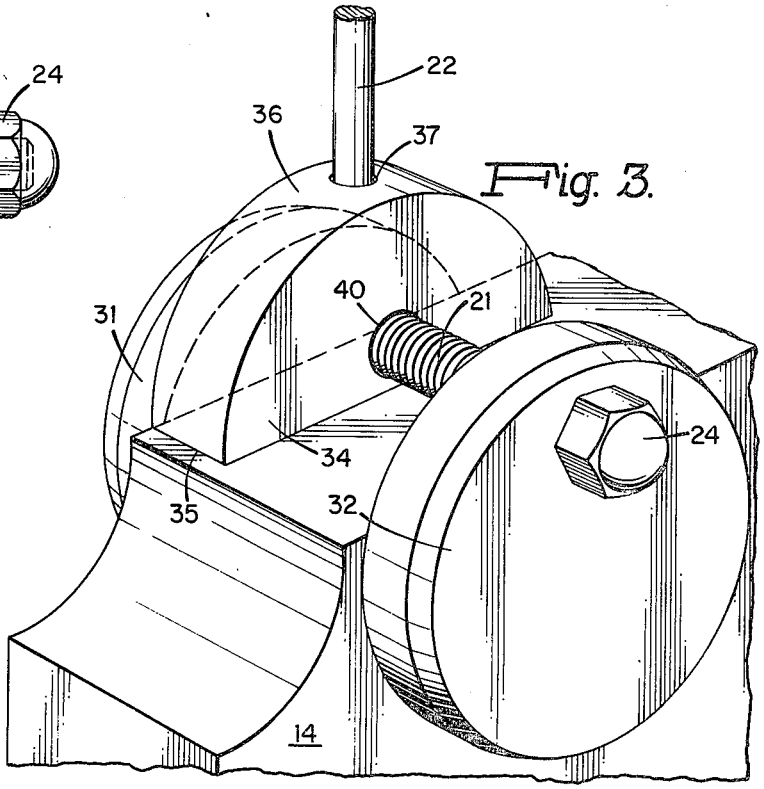
FIG. 3 is a perspective view of a second embodiment of the invention.

Castings of less complexity can be used with the addition of an additional member 34. Thus, in FIG. 3 a second embodiment is depicted in which side members 32 and 31 are flat discs. Coacting with flat discs 31 and 32 is a smaller member 34. Member 34 is curved or decoratively shaped on its upper surface 36 and flat on its bottom surface 35 for resting on top of the mounting structure. Top surface 36 of member 34 has hole 37 for receiving a flagstaff. Bolt 21, identical to that in the embodiment of FIG. 1 and 2, passes through aperture 38 in member 32, aperture 40 in member 34 and is threaded into threaded aperture 41 in member 31. Cap nut 24 is threaded over bolt 21 as in the embodiments of FIG. 1 and 2.

In use, flagholders in accordance with the embodiments described above, are readily installed on a gravestone or similar structure by threading bolt 18 into place and tightening with cap nut 24. Flagholders according to the invention made for a known thickness of mounting structure, for example a particular type of gravestone, would be made with headed bolts of the correct length avoiding the necessity of the cap nut. In order to use flagholders, in accordance with the invention, for mounting on different structures of different thicknesses from time to time, a threaded rod and standard machine nut can be used with a small loss in decorative appearances.

While the invention has been described with respect to specific embodiments, obvious variations are contemplated , and it is intended to cover the invention within the scope of the appended claims.

I claim:

1. A flagholder for clamping to an upright structure of limited thickness comprising:

(a) a first support member having a portion with a single horizontal threaded aperture;

(b) a second support member similar to said first support member having a single horizontal aperture in the place of said threaded aperture;

(c) a single vertical aperture intersecting said threaded aperture in said first support member for receiving a flagstaff; and, (d) a threaded bolt interconnecting said first and second support members by passing through the aperture in said second support member and being threaded into the aperture in said first support member for both drawing said first support member and said second support member together about said upright structure and pinning said flagstaff in said vertical aperture.

* * * * *